US006179434B1

(12) United States Patent
Saraiji

(10) Patent No.: US 6,179,434 B1
(45) Date of Patent: Jan. 30, 2001

(54) MODULAR LIGHTING SYSTEM FOR PRODUCT DISPLAY UNIT

(75) Inventor: Riad Saraiji, Fairfax, VA (US)

(73) Assignee: Illumitech, LLC., Fairfax, VA (US)

( * ) Notice: Under 35 U.S.C. 154(b), the term of this patent shall be extended for 0 days.

(21) Appl. No.: 09/243,784

(22) Filed: Feb. 3, 1999

(51) Int. Cl.[7] ..... A47F 11/10

(52) U.S. Cl. ..... 362/125; 362/133; 362/294; 108/23

(58) Field of Search ..... 362/249, 125, 362/145, 294, 373, 133, 217; 108/23; 312/237

(56) References Cited

U.S. PATENT DOCUMENTS

| | | | | |
|---|---|---|---|---|
| 2,822,672 | | 2/1958 | Dickson et al. . | |
| 3,304,740 | | 2/1967 | Dickson et al. . | |
| 3,612,848 | | 10/1971 | Koch et al. . | |
| 3,986,018 | | 10/1976 | Ishii . | |
| 4,000,407 | | 12/1976 | Keller et al. . | |
| 4,005,135 | | 1/1977 | Helding . | |
| 4,145,893 | | 3/1979 | Vogel . | |
| 4,356,540 | | 10/1982 | Goralnik . | |
| 4,361,012 | | 11/1982 | Ibrahim . | |
| 4,489,995 | | 12/1984 | Barr . | |
| 4,544,992 | | 10/1985 | Cover . | |
| 4,704,660 | | 11/1987 | Robbins . | |
| 4,748,545 | | 5/1988 | Schmitt . | |
| 4,825,341 | | 4/1989 | Awai . | |
| 4,887,154 | | 12/1989 | Wawro et al. . | |
| 4,941,327 | | 7/1990 | Miles . | |
| 4,993,561 | * | 2/1991 | Stultz | 211/55 |
| 5,147,130 | | 9/1992 | Watanuki . | |
| 5,172,973 | | 12/1992 | Spada . | |
| 5,269,231 | | 12/1993 | Johnson . | |
| 5,283,721 | | 2/1994 | Powell . | |
| 5,321,595 | | 6/1994 | Jacobi et al. . | |
| 5,341,275 | | 8/1994 | Ghandehari . | |
| 5,381,320 | * | 1/1995 | Jordan | 362/223 |
| 5,508,898 | | 4/1996 | McGovern . | |
| 5,517,826 | | 5/1996 | Duffy . | |
| 5,626,028 | | 5/1997 | Graat et al. . | |
| 5,658,067 | | 8/1997 | Engle et al. . | |
| 5,690,415 | | 11/1997 | Krehl . | |
| 5,785,585 | * | 6/1998 | Latchinian | 108/23 |
| 5,902,034 | * | 5/1999 | Santosuosso et al. | 362/223 |

* cited by examiner

*Primary Examiner*—Thomas M. Sember
(74) *Attorney, Agent, or Firm*—Everett G. Diederiks, Jr.

(57) ABSTRACT

A lighting system includes an illumination source arranged within a housing wherein the housing is positioned at a front end portion of a shelf of a product display unit. In a preferred form of the invention, thermal insulation is disposed between the housing and the shelf such that the shelf is thermally isolated from heat generated by the lighting unit. The lighting unit can be attached to or formed integral with the front portion of the shelf so as to act as an extension thereof or arranged beneath the shelf, preferably with an air gap or other type of thermal material barrier therebetween. In accordance with a preferred embodiment of the invention, the lighting unit takes the form of an elongated housing which is slidably mounted within a label receiving area of a shelf. The invention also contemplates lighting upper and lower shelves with a single lighting unit and providing the light housing with a label receiving area, which can be lit, to provide consumers with information concerning products to be supported on the shelf.

30 Claims, 5 Drawing Sheets

MODULAR LIGHTING SYSTEM FOR PRODUCT DISPLAY UNIT

BACKGROUND OF THE INVENTION

1. Field of the Invention

The present invention pertains to the art of illumination and, more particularly, to a modular lighting system for use in connection with one or more shelves of a product display unit.

2. Discussion of the Prior Art

Utilizing lighting units to illuminate products displayed on shelves of display cabinets or the like is widely known in the art. For instance, it is common to attach one or more lighting fixtures within a refrigerated display cabinet of a supermarket in order to illuminate food products supported on vertically spaced shelves of the cabinet. Most commonly, fluorescent lighting is used for this purpose, although it has been known to utilize incandescent lighting.

Regardless of the specific type of lighting source utilized, the additional source of lighting can advantageously enhance the visibility of food products for consumers, while the lighting fixtures can also have a detrimental effect on the refrigeration system. More specifically, all types of lighting sources generate heat which is counterproductive to the refrigeration system. Typically, the lighting units are mounted to an upper cabinet panel or directly beneath shelves of the display unit to illuminate food items placed on a lower shelf. In any case, the lights will dissipate heat by convection, radiation and conduction. The heat will inherently rise and at least raise the temperature of the products displayed above the lighting source.

Since many products must be maintained within a certain temperature range in order to sustain a desired shelf life, it is also known in the art to compensate for the heat developed by the lights by increasing the level of refrigeration produced. This need for increased refrigeration will result in longer compressor running periods and/or higher capacity refrigeration systems to be incorporated into the display cabinet. In any case, the costs associated with operating the display cabinet are raised, thereby representing an additional expense for the supermarket that is typically reflected in overall product prices.

Although the use of such lighting systems has certain negative aspects, the use of these lighting systems are still deemed necessary in many environments, particularly refrigeration display cabinets. Even in the case of display units used to support other products which do not require a dedicated refrigeration system, illuminating the products may still be desirable. However, the additional heat produced can still have a detrimental effect.

Proposals have been made in the art to minimize these negative heating effects. For instance, one major reason for the switch from incandescent to fluorescent lighting fixtures was that fluorescent lighting tends to develop lower levels of heat for a given light output. However, the use of fluorescent lighting can still develop a significant amount of heat which needs to be considered in the overall design of a display unit. Regardless of the type of lighting source utilized, prior emphasis has been mainly placed on insulating a lighting source from its own housing so as to indirectly insulate a display cabinet. Such an arrangement is exemplified in U.S. Pat. No. 4,748,545. This type of arrangement fails to take into account that the light housing can be used as a direct means to evenly distribute and dissipate the developed heat.

When contemplating the retrofitting of display units which were not originally designed for use with lighting systems, consideration must be given to numerous factors, including reasonable cost constraints, sizing parameters, the manner in which heat from the lighting system will affect products stored on shelves of the display and the aesthetics of the final overall unit. In general, little emphasis has been placed in the past on retrofitting food display cabinets or the like with lighting systems. That is, new lighting systems may be designed when production is changed on a refrigerated food display cabinet, but little or no efforts have been undertaken to retrofit existing food display cabinets with more efficient lighting systems or to even add lighting systems to non-refrigerated food product displays.

Based on the above, there exists a need in the art for an improved lighting system for a food product display unit wherein the heat generated by the lighting system is efficiently, thermally isolated from displayed products. In addition, there exists a need in the art for a modular lighting system which will enable the easy retrofitting of standard food display units and that can be readily implemented in the manufacturing of new display units, while having an aesthetic design so as to be pleasing to consumers.

SUMMARY OF THE INVENTION

In accordance with the present invention, a modular lighting system is provided for illuminating products supported upon various vertically arranged shelves of a display unit. In accordance with an aspect of the invention, the lighting system includes a housing which is attached to a front end portion of an upper shelf, with the housing including at least one transparent panel which permits an internal illumination source to light products supported upon a lower shelf. Provisions are also made for creating a thermal barrier between the housing and the upper shelf for insulating the upper shelf from the heat generated during operation of the lighting system. Additional or alternative transparent panels or openings can be provided to light other areas, such as for products provided on the upper shelf itself or even to a frontal face portion of the light housing which can be used to support product labels such that the labels are illuminated from the rear.

In accordance with one embodiment of the invention, the lighting unit is supported beneath an upper shelf with a layer of thermal insulation interposed between the light housing and the shelf. In another embodiment, the light housing is attached to a face portion of the shelf so as to constitute an extension of the shelf. In one preferred form of the invention, the lighting system is utilized in connection with a shelf having a label receiving channel formed at a front face portion thereof. The light housing includes one or more brackets which are received within the label receiving channel. In any case, the lighting system of the present invention can be readily retrofitted to existing display units or incorporated into newly manufactured display units. In addition, the lighting system is designed to be efficient in operation and structured to enhance the emission of light therefrom.

Additional objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
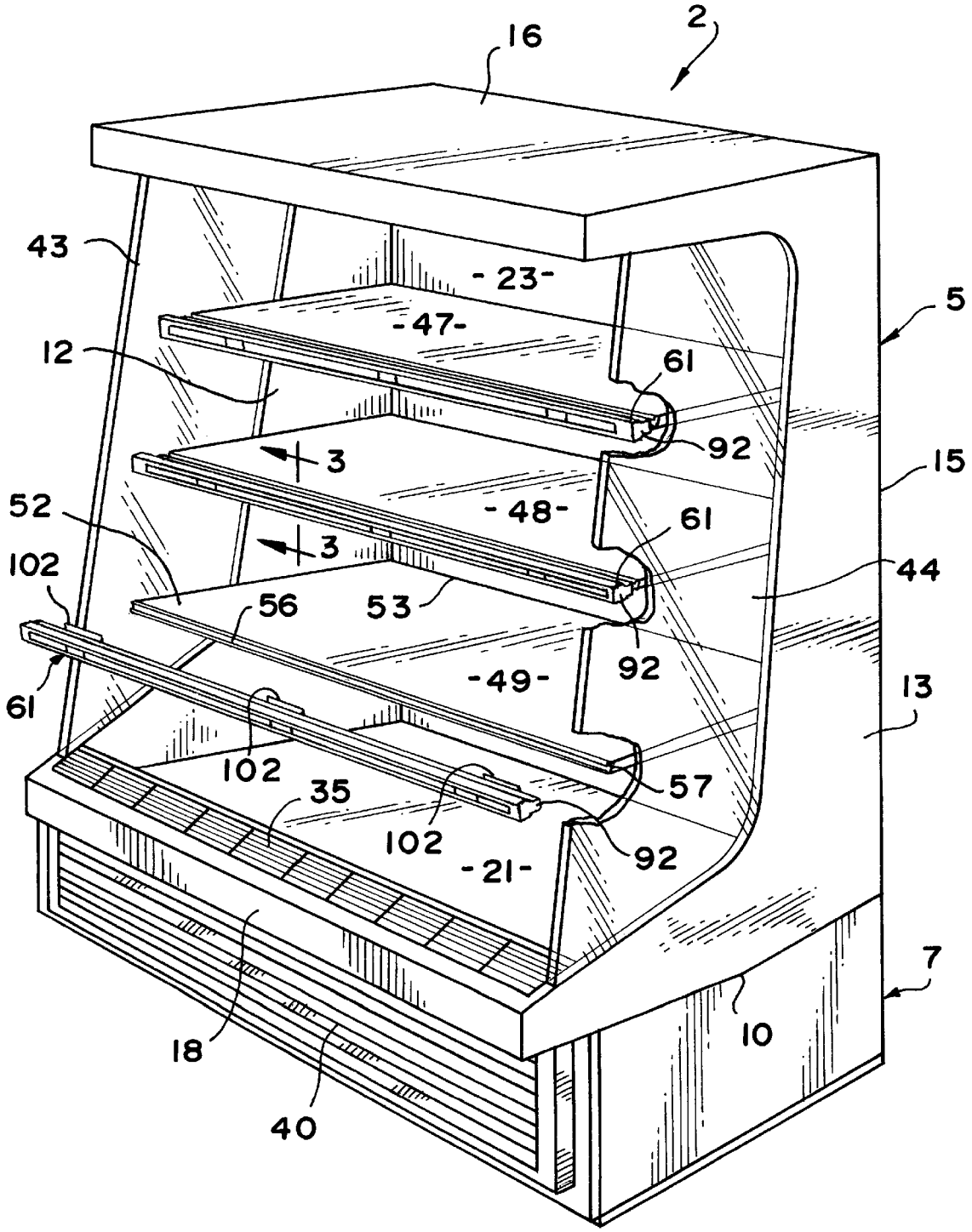
FIG. 1 is a perspective view of a refrigerated display cabinet incorporating the modular lighting system of the invention.
Figure 2:
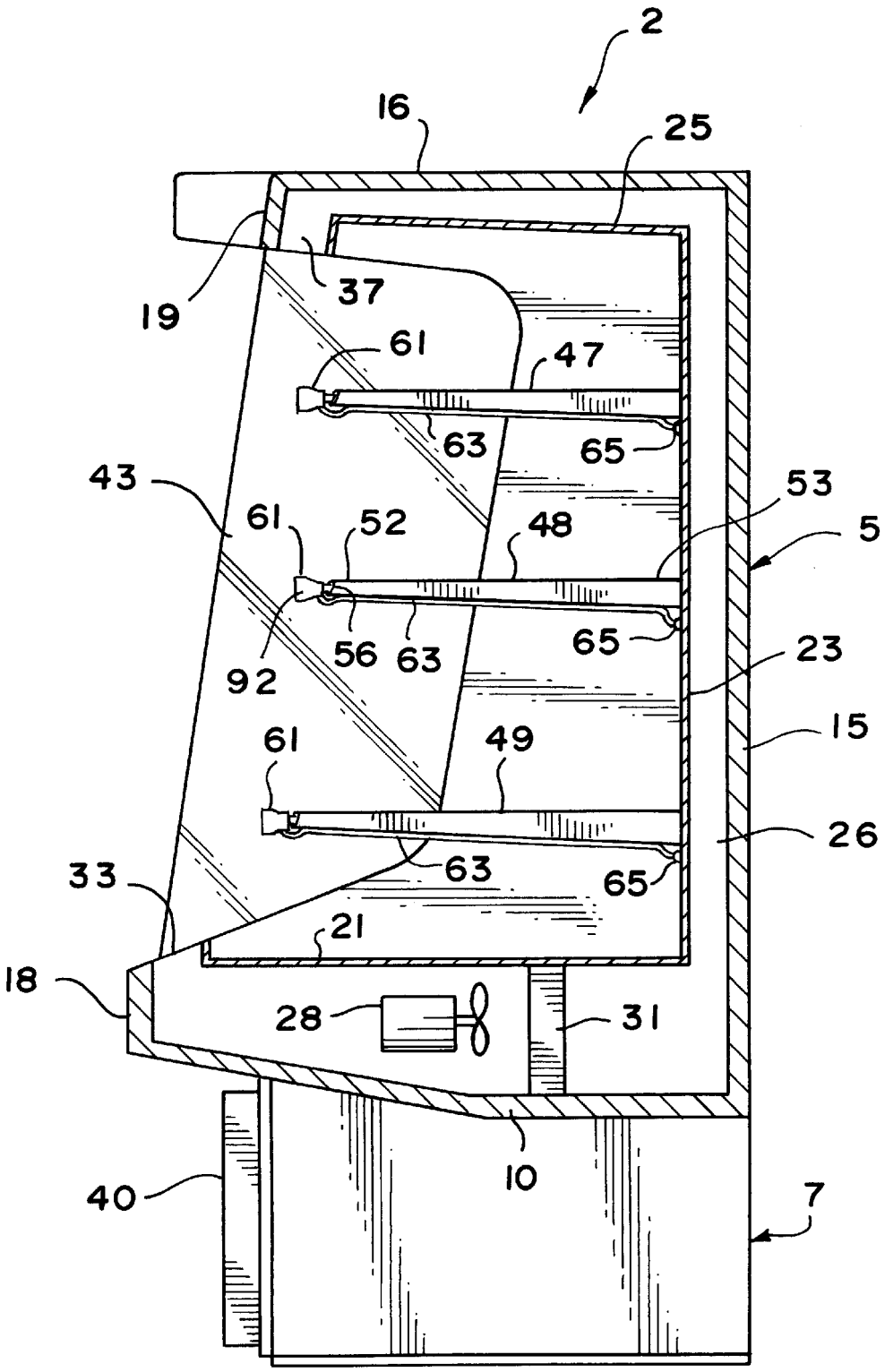
FIG. 2 is a side, cross-sectional view of the cabinet of FIG. 1.

With initial reference to FIGS. 1 and 2, the invention shown in connection with a refrigerator display cabinet generally illustrated at 2. Display cabinet 2 includes an upper frame 5 which is seated upon a base 7. More particularly, upper frame 5 includes a bottom wall 10, side walls 12 and 13, a rear wall 15 and a top wall 16. Bottom wall 10 has a front end which is turned upward to define a face portion 18. Similarly, top wall 16 has a front portion which is turned downward so as to define a face portion 19. Upper frame 5 of display cabinet 2 also includes an inner, a lower panel 21, a rear panel 23 and a top panel 25. Panels 21, 23 and 25 are spaced from bottom wall 10, rear wall 15 and top wall 16 respectively such that an air flow channel 26 is formed between these portions of display cabinet 2 as clearly shown in FIG. 2.

Air flow channel 26 forms part of a refrigeration circuit for display cabinet 2. More specifically, a fan 28 is positioned between lower panel 21 and bottom wall 10 to direct a flow of air across cooling coils 31. Fan 28 draws the air through air intake 33 which extends across a lower front portion of display cabinet 2 and which is provided with a grill 35. After the air is cooled by passing across cooling coils 31, the air continues to flow through channel 26 to air outlet 37. Although not shown due to the cross-sectional view taken, rear panel 23 would also be provided with a plurality of spaced holes which would further enable a flow of cooling air into display cabinet 2. In general, this cooling of display cabinet 2 is conventional in the art. For this reason, the compressor, evaporator and additional refrigeration system structure is not shown. For a self-contained refrigerated display cabinet 2, these components are mounted within base 7, with the heat generated thereby being able to escape through louvers 40 provided on a front portion of base 7 and the back of display cabinet 2.

In the embodiment shown, display cabinet 2 is also provided with opposing transparent side wall plates 43 and 44 which enhance the ability of consumers to view products stored upon a plurality of vertically spaced shelves 47–49 arranged in display cabinet 2. As is known in the art, shelves 47–49 are preferably supported, in a cantilevered manner, from rear panel 23. In addition, shelves 47–49 generally increase in depth from shelf 47 to shelf 49 and are used in combination with lower panel 21 to support food products, such as dairy foods which need to be refrigerated, within a supermarket or the like. Except for the difference in the depth of shelves 47–49, shelves 47–49 are generally identical in construction, with each including a front portion 52 and a rear portion 53 which extend laterally substantially the entire distance between side walls 12 and 13, as well as transparent side wall plates 43 and 44. Typically, such shelves 47–49 are made of metal but could also be made of plastic as far as the present invention is concerned. In addition, as illustrated with respect to shelf 49, each of shelves 47–49 includes a front face portion 56 that defines a channel 57 adapted to receive a pricing label or the like.

Again, this basic structure of refrigerator display cabinet 2 is known in the art and does not form part of the present invention. Therefore, further details of this construction will not be presented here. The present invention is particularly directed to the incorporation of a lighting system, including one or more lighting units, one of which is indicated at 61, for illuminating products displayed within cabinet 2. In the embodiment shown in FIGS. 1 and 2, a separate lighting unit 61 is mounted across the face portion 56 of each of shelves 47–49 and each lighting unit 61 includes a power cord 63 including a terminal plug 65 which is received within a socket (not shown) formed in rear panel 23. Since it is known in the art to provide lighting units mounted beneath shelves in a display cabinet, it is also known in the art to provide sockets in a corresponding rear panel. Therefore, the routing of the electricity to lighting unit 61 is done in a manner known in the art and is not considered an aspect of the present invention.

Figure 3:
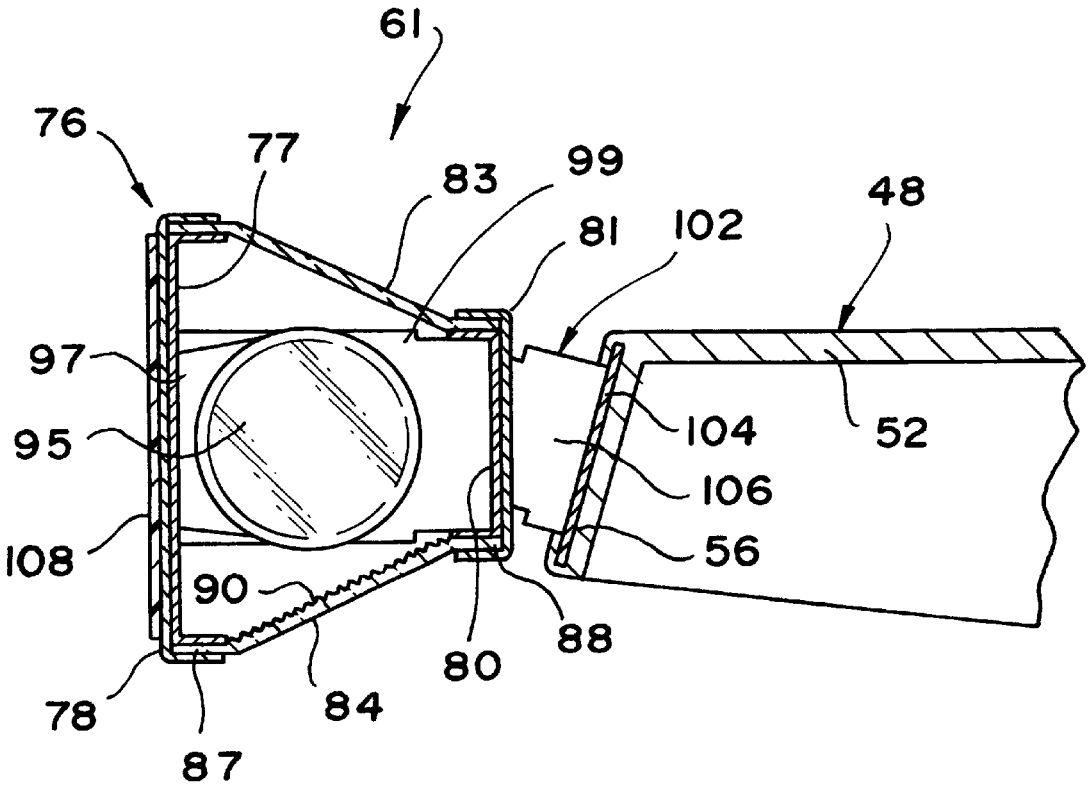
FIG. 3 is an enlarged, cross-sectional side view, generally taken along line 3—3 in FIG. 1, showing the mounting of a lighting unit to a shelf of the cabinet in accordance with a first preferred embodiment of the invention.

Reference will now be made to FIG. 3 in describing structural details of a preferred embodiment for lighting unit 61. As shown in this figure, lighting unit 61 includes a housing 76 preferably formed from inner and outer front, generally U-shaped plates 77 and 78, inner and outer rear, generally U-shaped plates 80 and 81, and upper and lower transparent plates 83 and 84. Inner and outer front U-shaped plates 77 and 78 are interconnected together. In a similar manner, inner and outer rear U-shaped plates 80 and 81 are interconnected together. As clearly shown in FIG. 3 with respect to lower transparent plate 84, a front end portion 87 of lower transparent plate 84 is received between non-labeled leg portions of inner and outer U-shaped plates 77 and 78 respectively, while a rear end portion 88 of lower transparent plate 84 is received between unlabeled legs of inner and outer rear U-shaped plates 80 and 81. A similar mounting arrangement is utilized in connection with upper transparent plate 83.

At this point, it should be realized that U-shaped plates 77, 78, 80 and 81, as well as plates 83 and 84, all preferably extend the entire width of housing 76, with that width being substantially equal to the width of any one of shelves 47–49. As also shown in FIG. 3, between front end portion 87 and rear end portion 88 of lower transparent plate 84 is defined an undulating, diffuser plate section 90. To complete housing 76, end caps, as best shown in FIGS. 1 and 2 at 92, extend across and about each of the inner and outer U-shaped plates 77, 78, 80 and 81.

Mounted within housing 76 is an illumination source 95. Although illumination source 95 can take various forms, including fluorescent and incandescent lamps, a fiber optic/light guide arrangement and the like, a single elongated fluorescent lamp is preferably utilized. In connection with this preferred embodiment, each end portion of housing 76 is provided with an electrical socket, such as that shown in 97. Although not clearly shown in this drawing due to the cross-section taken, each socket 97 is preferably secured to housing 76 through the use of a first mechanical fastener that extends through inner and outer front U-shaped plates 77 and 78, as well as a second mechanical fastener extending through inner and outer rear U-shaped plates 80 and 81. In a most preferred form, these mechanical fasteners take the form of nuts and bolts with lock washers. However, other attachment arrangements, including welding and the like could equally be applied. In any event, the attaching of sockets 97, in combination with end caps 92, aid in maintaining a desired spacial relationship between the sets of inner and outer plates 77, 78 and 80, 81 and enhance the structural integrity of the overall housing 76. Preferably, each of the sockets 97 is actually carried by a respective bracket 99 which itself is affixed between the sets of plates 77, 78 and 80, 81. Of course, suitable electrical wiring interconnects the end sockets 97 and extends out of housing 76 to define power cord 63 in order to provide electrical energy to illumination source 95.

Even though fluorescent lighting is utilized in accordance with the present invention, the various lighting units 61 can develop heat which is counterproductive to the refrigeration system of display cabinet 2. Since each lighting unit 61 is attached to a respective shelf 47–49 in accordance with the present invention, it is important to prevent heat from dissipating from the lighting unit 61 to the shelves 47–49. As the food products which need to be refrigerated would be supported directly upon the shelves 47–49, heating the shelves could have an extremely detrimental effect to the shelf life of the products. For this reason, it is an object of the present invention to thermally isolate the heat developed by the lighting units 61 from the shelves 47–49. At the same time, it is desirable to enable lighting units 61 remain fairly warm to optimize the lighting output. This is particularly important when utilizing fluorescent lighting.

With this in mind, FIGS. 1–3 show a first preferred construction and mounting for the lighting system of the present invention. More particularly, attached to housing 76 and projecting from outer rear U-shaped plate 81 is a plurality of laterally spaced support brackets 102. Each support bracket 102 includes a base 104 that is spaced from outer rear U-shaped plate 81 and attached to housing 76 by a pair of legs 106 of support bracket 102. In the preferred form, each support bracket 102 is formed by bending a single piece of sheet metal to define the base 104 and legs 106. Legs 106 are actually in-turned to define tab portions which are secured to outer rear U-shaped plate 81. In the most preferred form, mechanical fasteners extend through both of inner and outer rear U-shaped plates 80 and 81 and through the tabs associated with legs 106.

For the sake of completeness, the base 104 of each support bracket 102 in the embodiment shown is approximately 5 inches (12.7 cm) in length, with one support bracket 102 being arranged adjacent each terminal end of housing 106 and a third support bracket 102 being centrally disposed (also see FIG. 1). With this arrangement, the brackets 102 are spaced in the order of 16 inches (approximately 40 cm), while each base 104 is also spaced from the outer rear U-shaped plate 81. Given that the sheet metal used to form support brackets 102 is extremely thin, i.e., in the order of 3⁵⁄₁₀₀ of an inch or 0.1 cm, there is very minimal surface area for which to conduct heat generated from illumination source 95 from housing 76 through support brackets 102 to a respective one of shelves 47–49. Instead, numerous air gaps are created between housing 76 and a respective shelf 47–49. Therefore, this bracket arrangement is particularly constructed in this fashion to provide this thermal insulating function.

As shown in FIGS. 1–3, each lighting unit 61 is preferably attached to the face portion 56 of a respective shelf 47–49 so as to act as an extension of the shelf. More particularly, the respective shelf 47–49 is initially removed from within display cabinet 2 such that the base 104 of each support bracket 102 can be successively slid into the label receiving channel 57 of the particular shelf 47–49. With this arrangement, each lighting unit 61 is suspended from the particular shelf 47–49 by its attachment with the label receiving channel 57. In this manner, it is very easy in accordance with the present invention to retrofit a conventional refrigeration display cabinet by removing a desired number of shelves and sliding into each selected shelf a respective lighting unit 61. The shelf can then simply be remounted within the display cabinet and the connection with plugs 65 made.

Given that label receiving channel 57 is angled with respect to a vertical, it is preferable in accordance with the present invention to form the support brackets 102 such that each leg 106 extends further from a respective shelf 47–49 at an upper portion of housing 76 thereof than at a lower portion. This is clearly illustrated at FIG. 3. With this construction, the base 104 of each support bracket 102 is arranged farther from outer rear U-shaped plate 81 at a top end than at a bottom end. For instance, in the most preferred form, each base 104 is spaced approximately ⁹⁄₁₆ inch (1.5 cm), while the lower end of each leg creates a space in the order of 0.28 inches (approximately 0.7 cm). This angling of legs 106 assures the optimal arrangement for upper and lower transparent plates 83 and 84 to enhance the lighting of products supported on shelves 47–49 by the illumination source 95 of the lighting unit 61. Since lighting unit 61 utilizes the label receiving channel 57 for mounting purposes, it is desirable to provide each lighting unit 61 with its own label area. This can take various forms in accordance with the present invention. For instance, FIG. 3 indicates a label holder 108 which generally constitutes a magnetic or adhesive strip that is attached to outer front U-shaped plate 78 of housing 76.

Figure 3A:
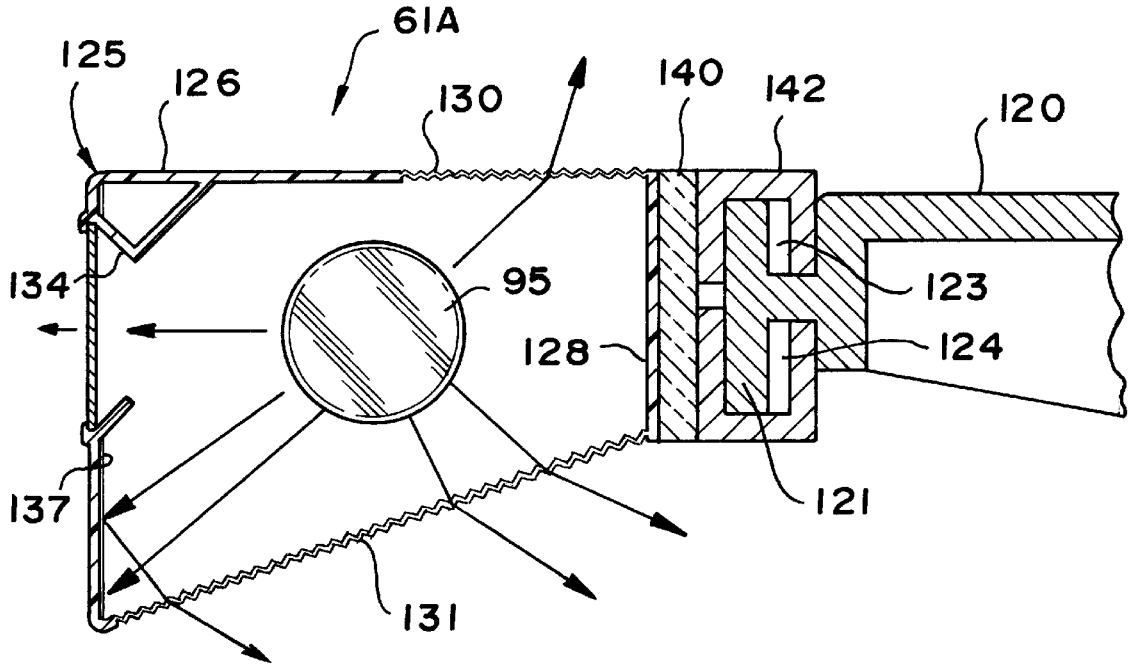
FIG. 3A is a partial cross-sectional side view of a second lighting unit embodiment of the invention attached to a display shelf.

As indicated above, the basic structure of shelves 47–49 of refrigerator display cabinet 2 as described is fairly common in the art. However, there are various manufacturers of refrigerator display cabinets and another commonly known cabinet arrangement incorporates a shelf 120 formed with a generally T-shaped front portion 121 as shown in FIG. 3A. The T-shaped portion 121 defines laterally elongated upper and lower grooves 123 and 124. FIG. 3A also illustrates another embodiment for the lighting unit 61A of the present invention. Here, you will note that the housing 125 is essentially formed of a first plate 126, a second plate 128 and upper and lower light refracting plates 130 and 131. In the most preferred form, plates 130 and 131 constitute light diffusing plates. Plates 126, 128, 130 and 131 are integrally connected together and at least first and second plates 126 and 128 can be formed of either metal or plastic.

More importantly, this embodiment illustrates certain additional aspects of the invention which are equally applicable to the various embodiments presented. First of all, it should be noted that housing 125 for this lighting unit 61A is itself formed with a label receiving channel 134. Therefore, the light housing of the present invention can have secured thereto a separate label holder or be integrally formed with a label receiving channel in a manner directly analogous to label receiving channel 57 of shelves 47–49 as described above. Second, this embodiment illustrates that the label receiving channel 134 can be open from behind so that any labels positioned therein would be advantageously illuminated by the lighting source 95. Of course, light could be equally reflected or otherwise directed to illuminate the label receiving channel 134. Next, this embodiment illustrates that the housing for the lighting unit can include reflective material 137, such as a reflective coating or metallic layer, to enhance the percentage of light dissipated from the housing. The first embodiment described above performed the thermal insulating aspect of the invention by minimizing the conductive area associated with the supporting brackets 102, while also adequately spacing the support brackets 102 from the housing 76. This embodiment illustrates that it is also possible to interpose a thermal insulating material 140 between light housing 125 and one or more support brackets 142. In this embodiment, a plurality of laterally spaced brackets 142 are utilized, with each bracket 142 defining a channel guide which extends about the T-shaped front portion 121 of shelf 120. Finally, this embodiment illustrates that other refractor-type plates can be utilized to aid in directing the light illuminated from illumination source 95 to the light housing. That is, where lower transparent plate 84 of the first embodiment is only undulating on the inner surface thereof, both inner and outer surfaces of each light refracting plate 130, 131 in accordance with this embodiment includes undulating surfaces. In general, the transparent plates incorporated in accordance with the present invention can be perfectly smooth or incorporate diffusing enhancing structure utilizing technology known in the art of optics without departing from the invention.

At this point, it should be realized that either lighting units 61 or 61A can be used to light products arranged on the shelf to which the lighting unit 61, 61A is attached, to illuminate a lower shelf or both the shelves in accordance with the present invention. Furthermore, a label receiving area can be illuminated in combination with one or more shelves. It is further possible to utilize the modular lighting system of the invention to simply provide an illuminated label area or to even provide an illuminated advertising sign on a shelf by enlarging the label area to generally constitute the entire front panel of light housing 125. When the modular lighting system is designed to just light a label or sign, it should be realized that light housing 125 could be reduced in size and a smaller light source, such as fiber optic lighting, could be used. In this case, the need for thermally insulating light housing 125 from the shelf would be minimized.

Figure 4:
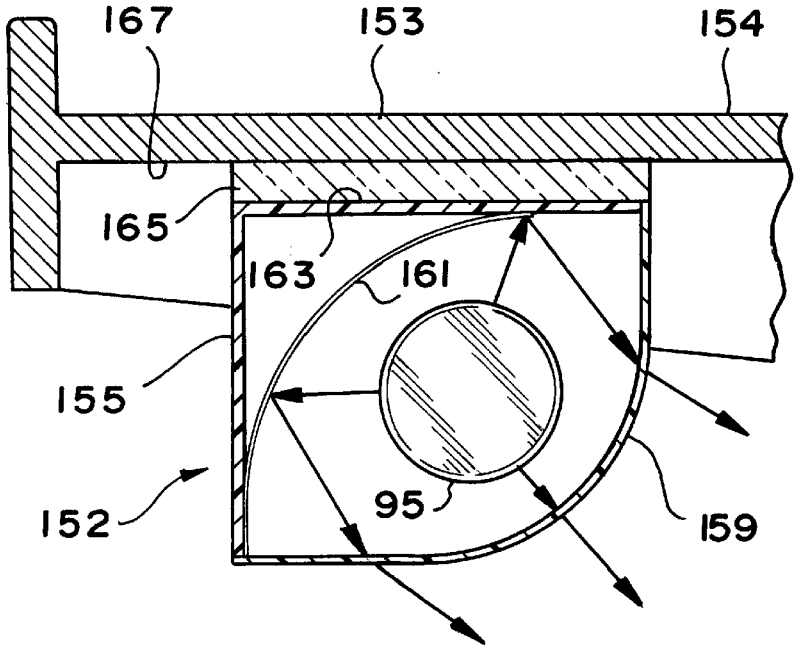
FIG. 4 is a cross-sectional side view showing the attachment of a third lighting unit embodiment to a display shelf.

FIG. 4 represents another embodiment of the invention wherein a light housing 152 is mounted to the front end portion 153 of a shelf 154, wherein the housing 152 is arranged beneath shelf 154. More specifically, housing 152 is shown to include a generally L-shaped shell 155 that extends laterally, substantially the entire width of shelf 154. Housing 152 also includes a transparent, generally curved plate 159 that is secured to the terminal ends of the L-shaped shell 155. Arranged within housing 152 is a bowed, reflective member 161 which enhances the dispersion of light through transparent plate 159 and out of housing 152. As indicated above, the mounting of lights under shelves in refrigerator display cabinets is known in the art. However, in accordance with the present invention, it should be noted that upper surface 163 of housing 152 has secured thereto a thermal insulative material 165 and housing 152 is attached to an underside 167 of shelf 154 directly through the thermal insulative material 165. This arrangement greatly minimizes the possibility of heat generated by illumination source 95 being directly conducted to shelf 154 or to products supported thereon. Therefore, this embodiment illustrates that the thermal insulation feature of the present invention can be incorporated into lighting systems mounted in different ways to the frontal portions of shelves.

Figure 5:
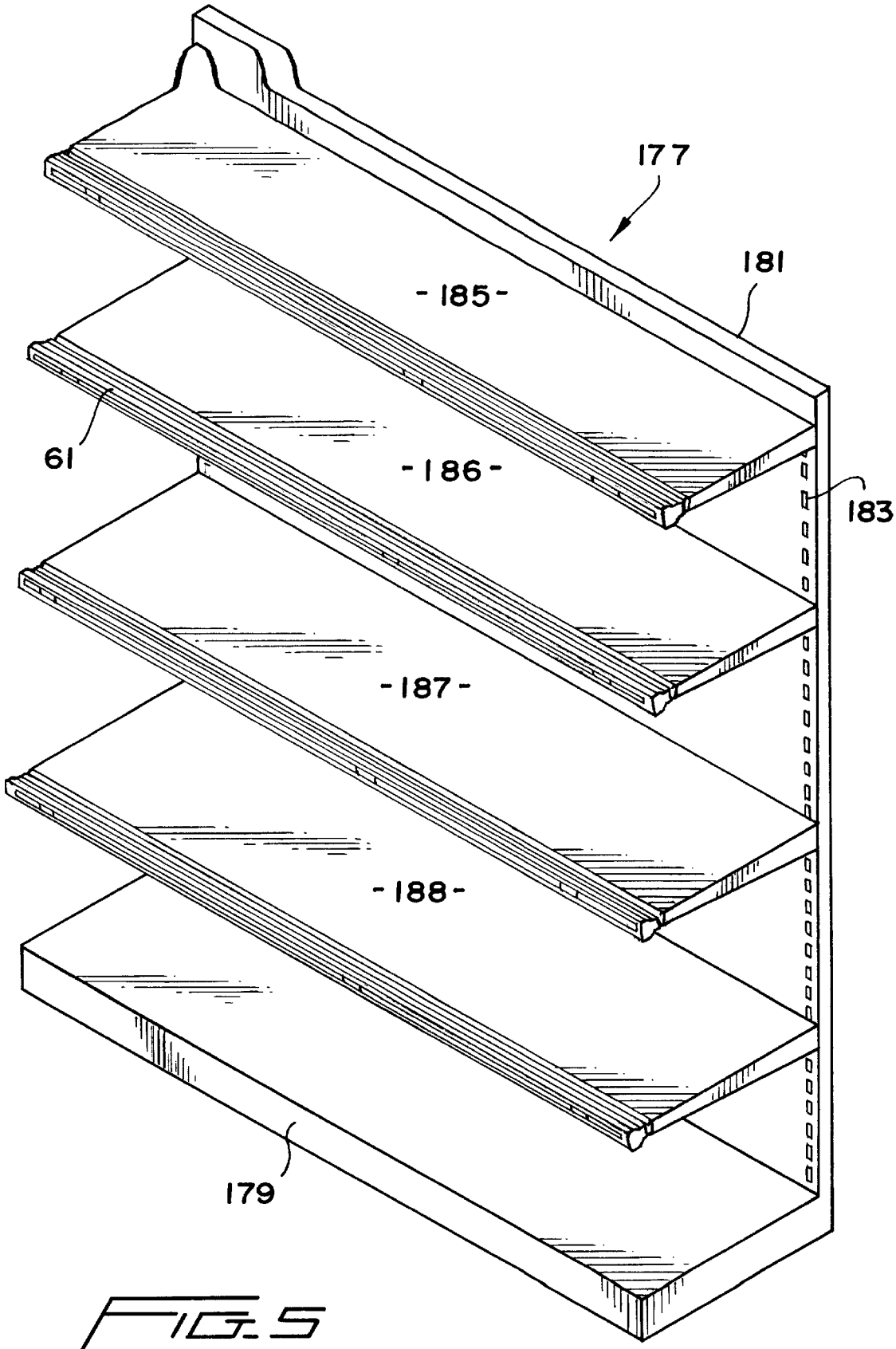
FIG. 5 is a perspective view of a non-refrigerated product display unit incorporating lighting units constructed in a manner corresponding to the first embodiment of the invention.

FIG. 5 illustrates that the lighting system of the present invention can also be advantageously incorporated into an open shelving unit generally indicated at 177. Shelving unit 177 is of the type generally utilized by supermarkets or the like to support items which do not need to be refrigerated. However, the lighting system of the present invention could also be used with an open shelving unit 177 for supporting various other types of items other than food products. In any event, as known in the art, open shelving unit 177 includes a base 179 from which extends an upstanding rear panel 181. Rear panel 181 is provided, at various laterally spaced positions, with a plurality of vertically aligned slots 183 for use in supporting cantilevered shelves 185–188. Such shelves generally include label receiving channels, similar to those described above with reference to channel 57 such that this figure illustrates the mounting of various lighting units 61 in a manner directly corresponding to that described above with reference to the embodiment of FIGS. 1–3. Of course, as the length of lighting unit 61 is increased, the number of supporting brackets 102 would be correspondingly increased for stability purposes.

Based in the above, it should be recognized that the lighting system of the present invention can be advantageously utilized in connection with various types of display units to illuminate numerous types of products without any worry of detrimental effects of the heat generated by the lighting unit being directly conveyed to the products through the shelves. Since the light housing is not insulated from the illuminating source 95, end caps 92 can be attached or placed in abutment with display cabinet 2 in accordance with the invention to actually use the cabinet as a heat sink. Furthermore, although the figures of the present application generally illustrate a separate lighting unit being attached to each shelf, it is quite possible to select only a certain number of shelves of a given unit or cabinet for the lights. This possibility is increased when the light housing incorporates both transparent panel portions at both upper and lower portions thereof.

Although described with respect to preferred embodiments of the invention, it should be readily understood that various changes and/or modifications can be made to the invention without departing from the spirit thereof. Instead, it should be recognized that there are various ways in which to support a lighting unit constructed in accordance with the present invention from a display shelf while providing specific structure for thermally isolating the shelf from the potentially detrimental effects of heat, particularly conductive heat, generated during operation of the lighting unit. For instance, the light housing could be made integral with the shelf or attached through a mechanical fastener, including snap-type connectors. In any event, the invention is only intended to be limited by the scope of the following claims.

I claim:

1. A modular lighting system for use on a product display unit including at least first and second vertically spaced product display shelves each having a substantially planar supporting surface with front and rear, laterally extending end portions comprising:

an elongated housing having terminal end portions and a front face portion defining a label receiving area, said housing being adapted to extend from the front end portion of the first shelf and including upper and lower panel portions, with at least a section of each of the upper and lower panel portions being transparent;

an illumination source mounted within the housing, said illumination source being adapted to generate light directed both above and below the first shelf and at the label receiving area; and means, adapted to be interposed between the first shelf and the housing, for thermally insulating the first shelf from the heat generated during operation of the illumination source.

2. A modular lighting system for use on a product display unit including at least first and second vertically spaced product display shelves each having a substantially planar supporting surface with front and rear, laterally extending end portions comprising:

an elongated housing having terminal end portions, said housing being adapted to extend from the front end portion of the first shelf;

an illumination source mounted within the housing, said illumination source being adapted to generate light directed towards the planar supporting surface of at least one of the first and second product display shelves; and means, interposed between the housing and the first shelf, for thermally insulating the first shelf from the heat generated during operation of the illumination source.

3. The lighting system according to claim 2, wherein the illumination source is encapsulated by the housing, said housing including a transparent portion through which the light can pass towards the planar supporting surface.

4. The lighting system according to claim 3, wherein said transparent portion is constituted by a light refracting plate.

5. The lighting system according to claim 2, wherein said housing is adapted to extend from an underside surface of the first shelf.

6. The lighting system according to claim 2, wherein said insulating means comprises a layer of thermal insulating material adapted to be disposed directly between the housing and the first shelf.

7. The lighting system according to claim 2, wherein the housing is adapted to project forward of the front end portion of the first shelf.

8. The lighting system according to claim 7, wherein the housing further includes upper and lower panel portions, with at least a section of each of the upper and lower panel portions being transparent such that the modular lighting system can illuminate areas both above and below the first shelf.

9. The lighting system according to claim 7, wherein said housing includes at least one mounting member adapted to be attached to a label receiving channel provided at the front end portion of the first shelf.

10. The lighting system according to claim 9, wherein the at least one mounting member is adapted to be slidably received within the label receiving channel.

11. The lighting system according to claim 9, wherein the at least one mounting member comprises a plurality of brackets extending from the housing at various laterally spaced locations.

12. The lighting system according to claim 2, wherein said housing includes a front face portion having a label receiving area.

13. The lighting system according to claim 12, wherein said label receiving area is adapted to be illuminated by light emitted from the illumination source.

14. The lighting system according to claim 2, further including means for heat sinking the housing to the product display unit through at least one of the terminal end portions of the housing.

15. A modular lighting system for use on a product display unit including at least first and second vertically spaced product display shelves each having a substantially planar supporting surface with front and rear, laterally extending end portions comprising:

an elongated housing having terminal end portions, said housing being adapted to extend from the front end portion of the first shelf, said housing including upper and lower panel portions, with at least a section of each of the upper and lower panel portions being transparent; and an illumination source mounted within the housing, said illumination source being adapted to generate light directed both above and below the first shelf.

16. The lighting system according to claim 15, wherein the housing is adapted to project forward of the front end portion of the first shelf.

17. The lighting system according to claim 16, wherein said housing includes at least one mounting member adapted to be attached to a label receiving channel provided at the front end portion of the first shelf.

18. The lighting system according to claim 17, wherein the at least one mounting member is adapted to be slidably received within the label receiving channel.

19. The lighting system according to claim 17, wherein the at least one mounting member comprises a plurality of brackets extending from the housing at various laterally spaced locations.

20. The lighting system according to claim 15, further comprising: means, interposed between the housing and the first shelf, for thermally insulating the first shelf from the heat generated during operation of the illumination source.

21. The lighting system according to claim 20, wherein said insulating means comprises a layer of thermal insulating material adapted to be disposed directly between the housing and the first shelf.

22. A modular lighting system for use on a product display unit including at least first and second vertically spaced product display shelves each extending across a substantial section of the product display unit and having a substantially planar supporting surface with front and rear, laterally extending end portions comprising:

an elongated housing having a front face portion and terminal end portions, said housing being adapted to be attached to a front end portion of the first shelf, said front face portion defining a slotted label receiving area; and an illumination source mounted within the housing, said illumination source being adapted to light said label receiving area.

23. The lighting system according to claim 22, wherein said housing is adapted to be mounted to an underside surface of the first shelf.

24. The lighting system according to claim 22, wherein the housing is adapted to be cantilevered from a frontal portion of the first shelf.

25. The lighting system according to claim 22, wherein the housing further includes upper and lower panel portions, with at least a section of each of the upper and lower panel portions being transparent such that the lighting unit is adapted to illuminate areas both above and below the housing.

26. The lighting system according to claim 22, further comprising: means, interposed between the housing and the first shelf, for thermally insulating the first shelf from the heat generated during operation of the illumination source.

27. The lighting system according to claim 26, wherein said insulating means comprises a layer of thermal insulating material adapted to be disposed directly between the housing and the first shelf.

28. The lighting system according to claim 22, wherein said housing includes at least one mounting member adapted to be attached to a label receiving channel provided at the front end portion of the first shelf.

29. The lighting system according to claim 28, wherein the at least one mounting member is adapted to be slidably received within the label receiving channel.

30. The lighting system according to claim 28, wherein the at least one mounting member comprises a plurality of brackets extending from the housing at various laterally spaced locations.

* * * * *